US009975128B2

(12) United States Patent
Zhou et al.

(10) Patent No.: US 9,975,128 B2
(45) Date of Patent: May 22, 2018

(54) ROTATABLE SHOWER SPRAYER

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Huasong Zhou, Xiamen (CN); Renmin Chen, Xiamen (CN); Donghai Chen, Xiamen (CN); Wei Wang, Xiamen (CN)

(73) Assignee: XIAMEN SOLEX HIGH-TECH INDUSTRIES CO., LTD., Xiamen, P.R. (CN)

( * ) Notice: Subject to any disclaimer, the term of this patent is extended or adjusted under 35 U.S.C. 154(b) by 31 days.

(21) Appl. No.: 15/102,150

(22) PCT Filed: Dec. 10, 2014

(86) PCT No.: PCT/CN2014/093434
§ 371 (c)(1),
(2) Date: Jun. 6, 2016

(87) PCT Pub. No.: WO2015/085918
PCT Pub. Date: Jun. 18, 2015

(65) Prior Publication Data

US 2016/0303587 A1 Oct. 20, 2016

(30) Foreign Application Priority Data

Dec. 13, 2013 (CN) ..... 2013 1 0684416
Dec. 13, 2013 (CN) ..... 2013 2 0824497 U

(51) Int. Cl.
*B05B 3/04* (2006.01)
*B05B 1/18* (2006.01)
*B05B 15/06* (2006.01)

(52) U.S. Cl.
CPC ..... *B05B 3/0422* (2013.01); *B05B 1/18* (2013.01); *B05B 1/185* (2013.01); *B05B 3/04* (2013.01); *B05B 15/061* (2013.01)

(58) Field of Classification Search
CPC ..... B05B 3/0422; B05B 1/18; B05B 1/185; B05B 3/04; B05B 15/061
(Continued)

(56) References Cited

U.S. PATENT DOCUMENTS 4,559,653 A 12/1985 Mathews
4,809,382 A * 3/1989 Ravn ..... A46B 13/06 15/29
(Continued)

FOREIGN PATENT DOCUMENTS

CN 201988467 U 9/2011
CN 202263663 U 6/2012
(Continued)

*Primary Examiner* — Arthur O Hall
*Assistant Examiner* — Adam J Rogers
(74) *Attorney, Agent, or Firm* — Rabin & Berdo, P.C.

(57) ABSTRACT

A rotating shower sprayer includes a housing, a cover plate component, and an impeller rotatably disposed in the housing. The top surface of the impeller has a blade. The eccentric position of the bottom surface of the impeller has a rotating shaft. The housing has an incline hole with respect to the blade. The shower sprayer also has a planetary reducing mechanism disposed in the housing. The planetary reducing mechanism comprises a gear sleeved on the rotating shaft and a fixing gear ring disposed on the internal revolution surface of the housing. The upper portion of the gear has a first stage reducing gear ring engaged to the fixing gear ring. The lower portion of the gear has a driving gear ring. The cover plate component is disposed with a second stage reducing gear ring that engages with the driving gear ring.

12 Claims, 4 Drawing Sheets

(58) Field of Classification Search
USPC ..... 239/240
See application file for complete search history.

(56) References Cited

U.S. PATENT DOCUMENTS

| | | | | |
|---|---|---|---|---|
| 5,385,532 | A * | 1/1995 | Shyu | A46B 13/06 15/29 |
| 5,397,064 | A * | 3/1995 | Heitzman | B05B 1/1636 239/101 |
| 6,338,170 | B1 * | 1/2002 | De Simone | A46B 13/06 4/606 |
| 7,946,512 | B2 * | 5/2011 | Schorn | B05B 1/185 239/225.1 |
| 8,403,240 | B2 * | 3/2013 | Chen | B05B 1/14 239/240 |
| 8,572,791 | B2 * | 11/2013 | Keusch | B60S 3/042 15/28 |
| 2008/0197211 | A1 | 8/2008 | Hsieh | |
| 2008/0223957 | A1 * | 9/2008 | Schorn | B05B 1/185 239/428.5 |
| 2012/0273593 | A1 * | 11/2012 | Clark | B05B 3/0431 239/242 |
| 2014/0008462 | A1 * | 1/2014 | Gransow | B05B 1/18 239/391 |

FOREIGN PATENT DOCUMENTS

| | | | |
|---|---|---|---|
| CN | 103657906 | A | 3/2014 |
| CN | 203591901 | U | 5/2014 |

* cited by examiner

ROTATABLE SHOWER SPRAYER

FIELD OF THE INVENTION

The present invention relates to a rotatable shower sprayer.

BACKGROUND OF THE INVENTION

Rotating outlet is a mature technology in sanitary device, a plurality of spraying nozzles are disposed in the outlet surface for synchronous outlet, a driving device is used to drive the whole outlet surface to rotate, so that the spraying nozzles revolute and outlet in a large area. Another kind of rotating outlet is that the spraying nozzles rotate on the axis, that is to say, each spraying nozzle rotates on its axis by the driving of the driving device to from water flowing with sub-thread rotating.

Above two kinds of rotating outlet, no matter outlet surface rotating or spraying nozzles rotating, can not be given consideration. Besides, the outlet surface and the spraying nozzles both rotate quickly that it can not achieve the visual effect and the shower feeling.

SUMMARY OF THE INVENTION

The present invention is provided with a rotating shower sprayer, which overcomes the disadvantages of the existing technology. The technical proposal of the present invention is that:

A rotatable shower sprayer, comprising a housing, a cover plate component, an impeller rotatably disposed in the housing, the top surface of the impeller is disposed with a blade, the eccentric position of the bottom surface of the impeller is disposed with a rotating shaft; the housing is disposed with an incline hole with respect to the blade; wherein the shower sprayer further comprises:

a planetary reducing mechanism disposed in the housing, the planetary reducing mechanism comprises a gear sleeved on the rotating shaft and a fixing gear ring disposed on the internal revolution surface of the housing, the upper portion of the gear is disposed with a first stage reducing gear ring engaged to the fixing gear ring, the lower portion is disposed with a driving gear ring;

the cover plate component is disposed with a second stage reducing gear ring inside to be engaged with the driving gear ring.

In another preferred embodiment, the shower sprayer further comprises a spindle and a fixing gear plate, the top end of the spindle passes through the impeller to connect to the top portion of the housing, the bottom end is inserted to the cover plate component to rotatably connect to the cover plate component, the fixing gear plate is concentrically fixedly connected to the bottom end of the spindle, a plurality of spraying nozzles are disposed in the cover plate component in annular array, the external surface of the spraying nozzle is disposed with a ring gear, the ring gear is engaged to the fixing gear plate.

In another preferred embodiment, the cover plate component further comprises an output rotating plate, a cover plate, and a cover, the cover plate covers the spraying nozzles into the cover, the output rotating plate is disposed in the housing, the cover plate is fixedly connected to the output rotating plate, the second stage reducing gear ring is disposed to the internal revolution surface of the output rotating plate.

In another preferred embodiment, a cup base is disposed in the cover, the spraying nozzles are disposed in the cup base.

In another preferred embodiment, the cover plate is threaded to the output rotating plate.

In another preferred embodiment, the shower sprayer comprises three rotating shaft arranged in annular array and three gears arranged in annular array.

In another preferred embodiment, the number of teeth of the first stage reducing gear ring is less than the number of teeth of the driving gear ring.

In another preferred embodiment, the housing comprises a connecting seat, a fixing seat and a fixing cover, the connecting seat covers the fixing seat, the fixing cover is connected to the top portion of the fixing seat to cover the impeller, the incline hole is disposed in the fixing seat, the fixing gear ring is disposed to the internal revolution surface of the fixing seat.

In another preferred embodiment, the external surface of the connecting seat is disposed with thread used to connect to the shower sprayer main body.

In another preferred embodiment, the impeller drives the cover plate component to rotate by the planetary reducing mechanism and the second stage reducing gear ring; the spraying nozzles in the cover plate component revolute with the cover plate component and rotate on the axis by the driving of the fixing gear plate.

Compared to the existing technology, the technical proposal of the present invention has advantages:

1. The cover plate component and the impeller transmit by ratio of transformation by the planetary reducing mechanism, the plane reducing mechanism can realize two-stage reducing, so that the impeller in high speed rotating can drive the cover plate component to rotate in low speed, at the same time, the spraying nozzles revolute with the cover plate component and also rotate on its axis, therefore, it can achieve better dynamic massage effect, it provides a quiet shower environment, and also provides perfect visual effect and human comfort. It has advantages of simple, compact and small structure.

2. When the cover plate component rotates, the fixing gear ring is engaged to the ring gear, the spraying nozzle rotates on its axis. Therefore, the spraying nozzles of the rotating shower sprayer of the present invention can not only revolute with the cover plate component, but also rotate on its axis by the driving of the fixing gear plate, it combines the revolution and rotating outlet methods.

3. The spraying nozzle is disposed in the cup base, so that it can rotate freely.

4. The cover plate is threaded to the output rotating plate, so that it is convenient to assemble and disassemble.

5. The present invention is disposed with three rotating shafts arranged in annular array and three gears arranged in annular array, the structure is stable, so that the planetary reducing mechanism runs smoothly.

BRIEF DESCRIPTION OF THE DRAWINGS

The present invention will be further described with the drawings and the embodiments.

DETAILED DESCRIPTION OF THE EMBODIMENTS

Figure 1:
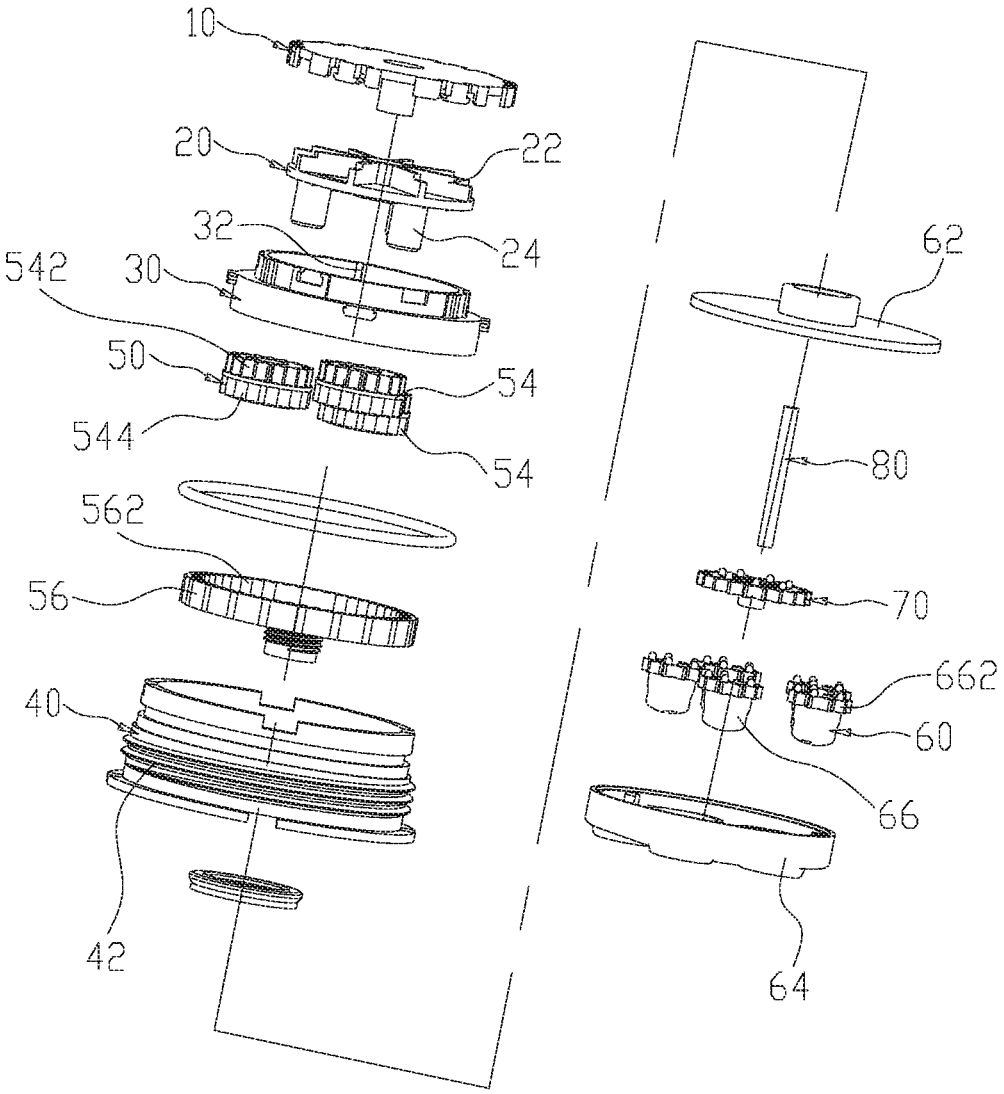
FIG. 1 illustrates an exploded and schematic diagram of the rotatable shower sprayer of the present invention.
Figure 2:
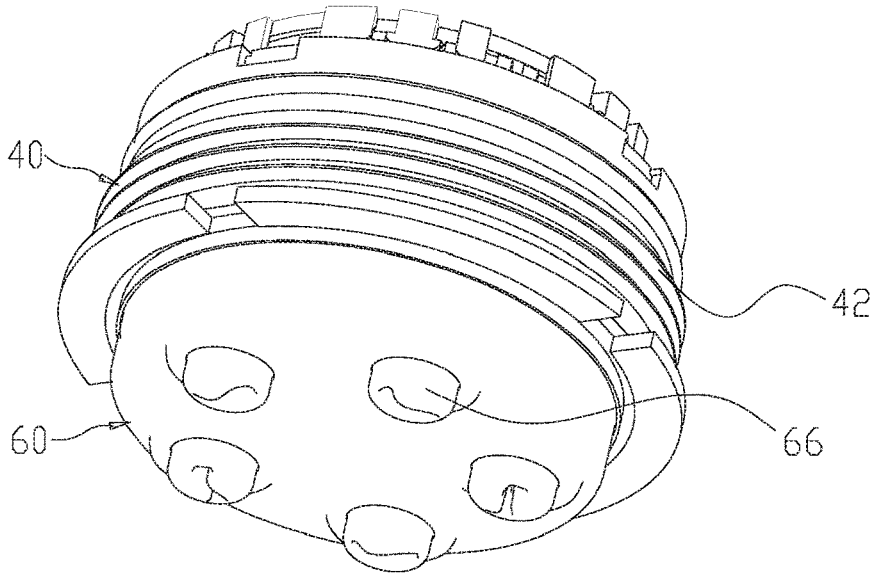
FIG. 2 illustrates a schematic diagram of the rotatable shower sprayer of FIG. 1.
Figure 3:
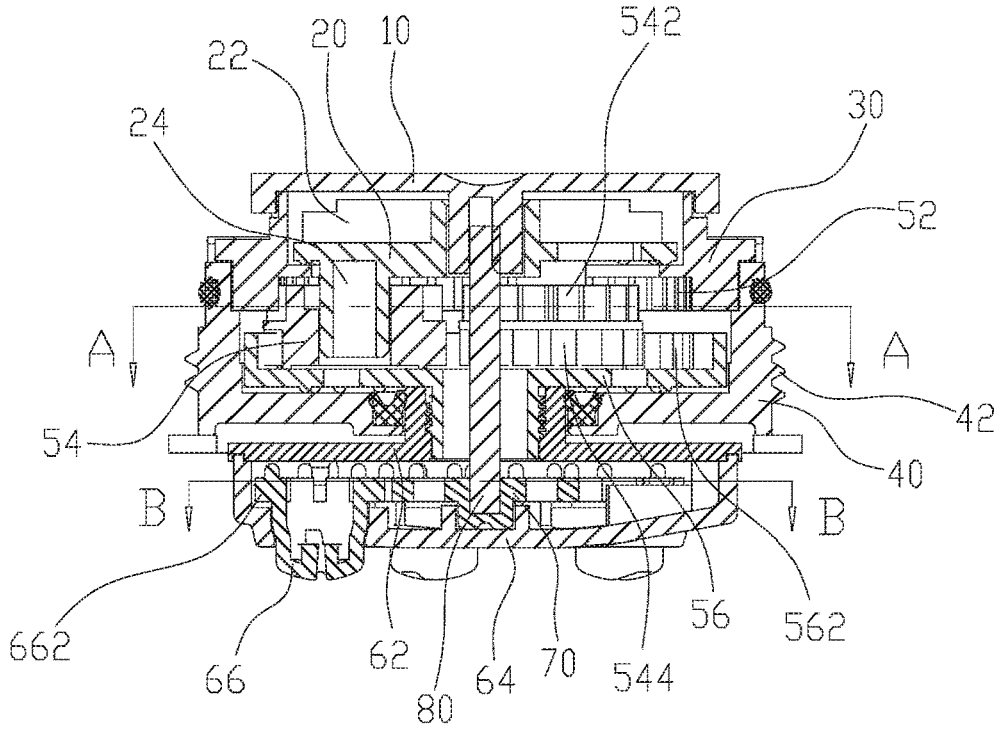
FIG. 3 illustrates a sectional diagram of the rotatable shower sprayer of FIG. 2.
Figure 4:
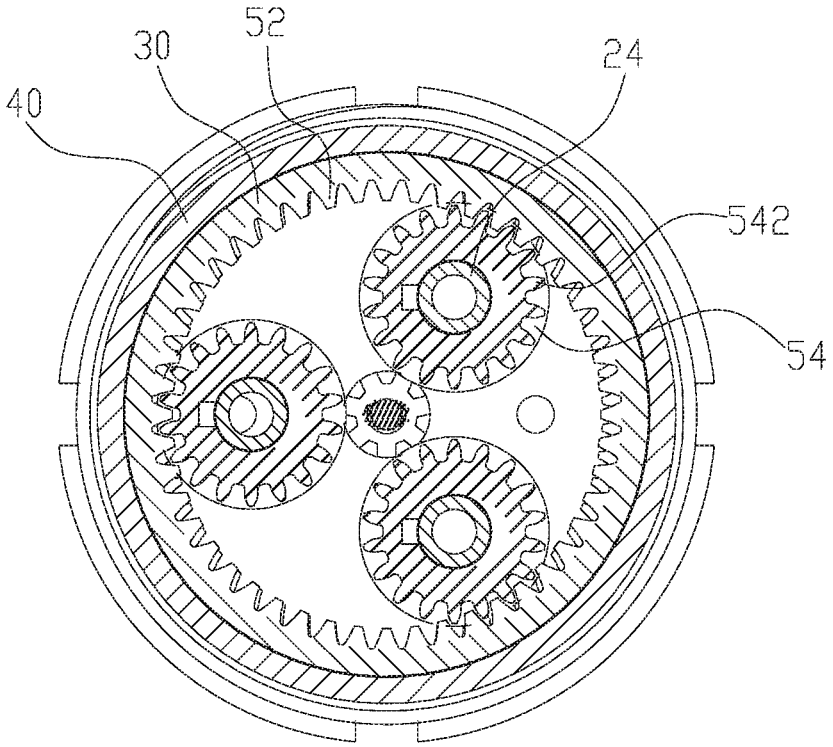
FIG. 4 illustrates a sectional diagram of FIG. 3 in A-A.
Figure 5:
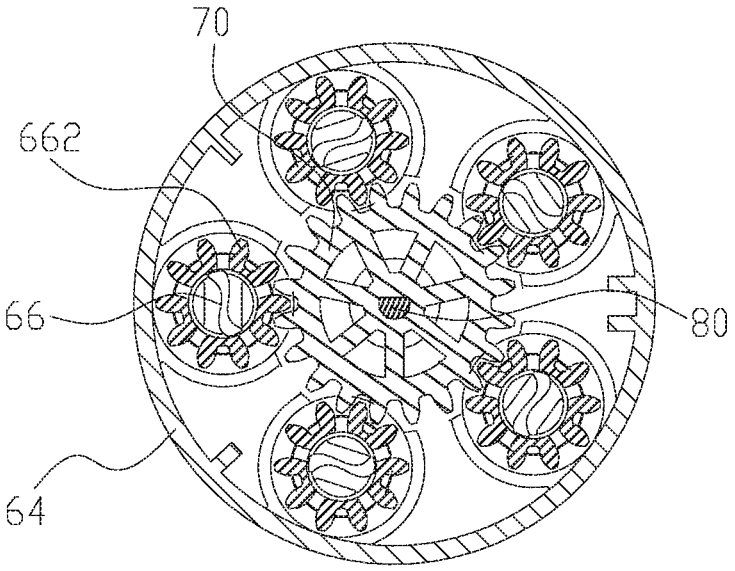
FIG. 5 illustrates a sectional diagram of FIG. 3 in B-B.

Referring to FIG. 1, a rotatable shower sprayer of the present invention comprises a fixing cover 10, an impeller 20, a fixing seat 30, a connecting seat 40, a planetary reducing mechanism 50, a cover plate component 60, a fixing gear plate 70 and a spindle 80. The cover plate component 60 is rotatable when in water flowing state, and at the same time, the spraying nozzles 66 of the cover plate component 60 can rotate on the axis.

Referring to FIGS. 1~4, the fixing cover 10, the fixing seat 30, the connecting seat 40 compose the housing of the rotatable shower sprayer of the present invention. The planetary reducing mechanism 50, the impeller is disposed in the housing.

The impeller is rotatable in the housing by the impacting of the water flowing. The top surface of the impeller 20 is disposed with a plurality of blades 22. The eccentric position of the bottom surface of the impeller 20 is disposed with three rotating shafts 24. The three rotating shafts 24 are arranged in annular array about the center of the impeller.

The fixing seat 30 is disposed with an incline hole 32 with respect to the impeller 22. The internal revolution surface of the fixing seat 30 is disposed with a fixing gear ring 52. The fixing seat 30 covers the impeller 20. The fixing cover 10 is connected to the top portion of the fixing seat 30 to cover the impeller 20.

The connecting seat 40 is used to connect to the shower head main body[s1]. The external revolution surface of the connecting seat 40 is disposed with thread 42 to connect to the shower head main body. The connecting seat 40 covers the fixing seat 30 and the planetary reducing mechanism 50.

The planetary reducing mechanism 50 is used to connect the impeller 20 and the cover plate component 60, so that the high-speed rotating impeller 20 can drive the cover plate component 30 to rotate in low speed. The planetary reducing mechanism 50 comprises a fixing gear ring 52 and three gears. The gear 54 is double-layer structure. The upper portion of the gear 54 is disposed with a first stage reducing gear ring 542 corresponding to the fixing gear ring 52, the lower portion of the gear 54 is disposed with a driving gear ring 544. Preferred, the number of teeth of the first stage reducing gear ring 542 is less than that of the driving gear ring 544. Three rotating shafts 24 are respectively inserted to the three gears 54, the three gears 54 are arranged in annular array about the center of the fixing seat 30. The fixing gear ring 52 is engaged to the first stage reducing gear ring 542 of the gear 54.

The cover plate component 60 comprises an output rotating plate 56, a cover plate 62, a cover 64 and a plurality of spraying nozzles. The internal revolution surface of the output rotating plate 65 is disposed with a second stage reducing gear ring 562 corresponding to the driving gear ring 544. The cover 64 is disposed with a plurality of cup bases, which are arranged in annular array about the center of the cover 64. The spraying nozzles 66 are respectively disposed in the cup bases. The external surface of the spraying nozzles 66 is disposed with ring gear 662. The cover plate 62 covers the spraying nozzles 66 in the cover 64. The cover plate 62 is threaded to the output rotating plate 56, the driving gear ring 544 of the gear 54 is engaged to the second stage reducing gear ring 562. Therefore, the impeller 20 drives the gears 54 to rotate, the gears 54 drive the output rotating plate 56 to rotate. So that the cover plate component 60 freely rotate.

The fixing gear plate 70 is fixedly disposed at the central position of the cover plate component 60 corresponding to the ring gears 662 of the spraying nozzles 66 and is engaged to the ring gears 662. One end of the spindle 80 passes through the impeller 20 to connect to the fixing cover 10, the other end of the spindle 80 is inserted to the cover plate component 60 to fixedly connect to the fixing gear ring 70.

When water flowing impacts the impeller 22 through the incline hole 32, the impeller 20 rotates in high speed about the spindle 80. The impeller 20 drives the gears 54 to rotate, the gears 54 drive the output rotating plate 56 to rotate in low speed. As the cover plate 62 is connected to the output rotating plate 56, the cover 64 synchronously rotates with the output rotating plate 56 (revolution). As the fixing gear plate 70 keeps still, when the cover plate component 60 rotate, the ring gears 662 of the spraying nozzles 66 and the fixing gear plate 70 are engaged to transmit, the spraying nozzles 66 rotate (rotating on its axis).

According to the working principle of the planetary reducing mechanism 50, when the number of teeth of the fixing gear ring 52 is 48, the number of teeth of the first stage reducing gear ring 542 is 18, the number of teeth of the driving gear ring 544 is 19 and the number of teeth of the second stage reducing gear ring 562 is 51, the transmission ratio of the planetary reducing mechanism 50 can reach to 153:1.

Figure 6:
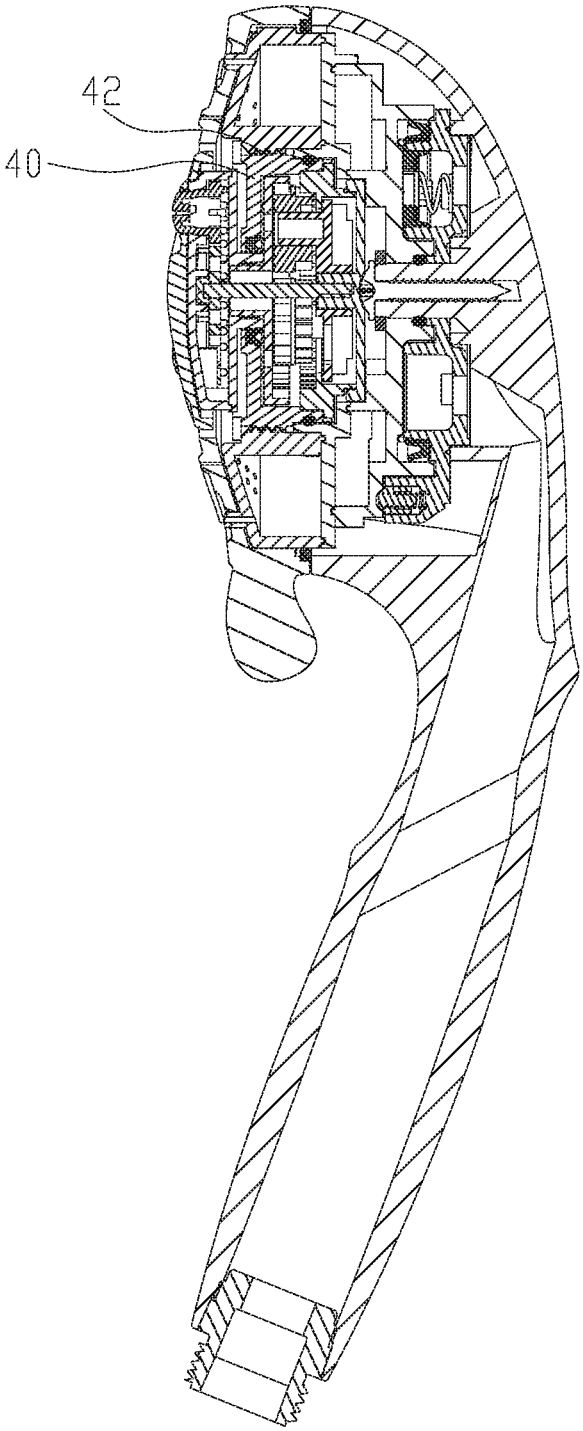
FIG. 6 illustrates a schematic diagram of the shower sprayer of the present invention assembled to a shower head.

Referring to FIG. 6, the thread 42 of the connecting seat 40 can be threaded to the shower head main body directly, it is convenient to assemble and disassemble.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention is provided with a rotating shower sprayer, the impeller drives the cover plate component to rotate by the planetary reducing mechanism, the second reducing gear ring, the spraying nozzles in the cover plate component can rotate on its axis by the driving of the fixing gear plate. The plane reducing mechanism can realize two-stage reducing, so that the impeller in high speed rotating can drive the cover plate component to rotate in low speed, at the same time, the spraying nozzles revolute with the cover plate component and also rotate on its axis, therefore, it can achieve better dynamic massage effect, it provides a quiet shower environment, and also provides perfect visual effect and human comfort.

The invention claimed is:

1. A rotatable shower sprayer, comprising:

a housing having an internal revolution surface and having an incline hole defined there through;

a cover plate component that is rotatable when water flows, that is comprised of a cover that has rotatably disposed therein a plurality of spraying nozzles each having a respective axis of rotation, the plurality of spraying nozzles being configured to rotate with the cover plate component and to rotate on each said respective axis of rotation when driven by rotation of the cover plate component, and that has disposed therein a second stage reducing gear;

an impeller that is rotatably disposed in the housing, that has a top surface, and that has a bottom surface including an eccentric position provided with a rotating shaft;

at least one blade disposed on the top surface of the impeller and the incline hole of the housing is disposed with respect to the at least one blade a planetary reducing mechanism that is disposed in the housing, and that comprises:

a gear sleeved on the rotating shaft; and a fixing gear ring disposed on the internal revolution surface of the housing, said gear having an upper portion that is disposed with a first stage reducing gear ring engaged to the fixing gear ring, and a lower portion that is disposed with a driving gear ring that engages the second stage reducing gear ring disposed in the cover plate component.

2. The rotatable shower sprayer according to claim 1, wherein the first stage reducing gear ring has a number of teeth that is less than that of the driving gear ring.

3. The rotatable shower sprayer according to claim 1, wherein the housing comprises:

a connecting seat;

a fixing seat that is covered by the connecting seat, that has a top portion, that has said incline hole defined therein, and that has an internal revolution surface on which is disposed the fixing gear ring; and a fixing cover that is connected to the top portion of the fixing seat to cover the impeller.

4. The rotatable shower sprayer according to claim 3, wherein the connecting seat has an external surface that is threaded and connected to the housing.

5. The rotatable shower sprayer according to claim 1, wherein the impeller drives the cover plate component to rotate by the planetary reducing mechanism and the second stage reducing gear ring when water flows, and the plurality of spraying nozzles disposed in the cover plate component revolute with the cover plate component and rotate on the axis thereof by the driving of the fixing gear plate.

6. A rotatable shower sprayer, comprising a housing;

a cover plate component;

an impeller that is rotatably disposed in the housing, that has a top surface on which a blade is disposed, and that has a bottom surface including an eccentric position provided with a rotating shaft;

a planetary reducing mechanism that is disposed in the housing, and that comprises:

a gear sleeved on the rotating shaft; and a fixing gear ring disposed on the internal revolution surface of the housing, said gear having an upper portion that is disposed with a first stage reducing gear ring engaged to the fixing gear ring, and a the lower portion that is disposed with a driving gear ring;

a spindle having a top end that passes through the impeller to connect to a top portion of the housing, and having a bottom end that is inserted into the cover plate component to rotatably connect to the cover plate component; and a fixing gear plate that is concentrically fixedly connected to the bottom end of the spindle, wherein the cover plate component is disposed with a second stage reducing gear ring inside to be engaged with the driving gear ring, wherein the housing is disposed with an incline hole with respect to the blade, and wherein a plurality of spraying nozzles are disposed in the cover plate component in an annular array, and the plurality of spraying nozzles have an external surface that is disposed with a ring gear that engages the fixing gear plate.

7. The rotatable shower sprayer according to claim 6, wherein the cover plate component further comprises:

an output rotating plate that is disposed in the housing;

a cover plate; and a cover, wherein the cover plate covers the plurality of spraying nozzles in the cover, and is fixedly connected to the output rotating plate which has an internal revolution surface, and wherein the second stage reducing gear ring is disposed to the internal revolution surface of the output rotating plate.

8. The rotatable shower sprayer according to claim 7, wherein the cover plate has threads and threadedly engages the output rotating plate.

9. The rotatable shower sprayer according to claim 7, wherein a cup base is disposed in the cover, and the plurality of spraying nozzles are disposed in the cup base.

10. The rotatable shower sprayer according to claim 6, wherein a cup base is disposed in the cover, and the plurality of spraying nozzles are disposed in the cup base.

11. The rotatable shower sprayer according to claim 6, wherein the impeller drives the cover plate component to rotate by the planetary reducing mechanism and the second stage reducing gear ring, and the plurality of spraying nozzles in the cover plate component revolute with the cover plate component and rotate on the axis thereof by the driving of the fixing gear plate.

12. A rotatable shower sprayer, comprising a housing;

a cover plate component having disposed therein a plurality of spraying nozzles;

an impeller that is rotatably disposed in the housing, that has a top surface on which a blade is disposed, and that has a bottom surface including an eccentric position provided with a rotating shaft; and a planetary reducing mechanism that is disposed in the housing, and that comprises:

a gear sleeved on the rotating shaft; and a fixing gear ring disposed on the internal revolution surface of the housing, said gear having an upper portion that is disposed with a first stage reducing gear ring engaged to the fixing gear ring, and a the lower portion that is disposed with a driving gear ring, wherein the cover plate component is disposed with a second stage reducing gear ring therein that engage the driving gear ring, wherein the housing is disposed with an incline hole with respect to the blade, and wherein the shower sprayer comprises three rotating shafts arranged in annular array and three gears arranged in an annular array.

* * * * *